United States Patent [19]

St. Louis et al.

[11] Patent Number: 4,836,741

[45] Date of Patent: Jun. 6, 1989

[54] BACKHOE HITCH APPARATUS

[75] Inventors: Paul T. St. Louis, Littleton; Charles L. Welch, Westminster, both of Colo.

[73] Assignee: Consolidated Technologies, Corp., Denver, Colo.

[21] Appl. No.: 191,856

[22] Filed: May 4, 1988

Related U.S. Application Data

[63] Continuation of Ser. No. 895,808, Aug. 12, 1986, abandoned.

[51] Int. Cl.[4] ..... E02F 3/96

[52] U.S. Cl. ..... 414/723; 172/272; 403/4; 403/19; 403/161

[58] Field of Search ..... 414/723; 172/272; 403/4, 19, 161, 162, 409.1, DIG. 8

[56] References Cited

U.S. PATENT DOCUMENTS

| | | | |
|---|---|---|---|
| 2,447,150 | 8/1948 | Andersen . | |
| 2,963,183 | 12/1960 | Przybylski . | |
| 3,003,651 | 10/1961 | Holopainen . | |
| 3,237,795 | 3/1966 | Kromer . | |
| 3,243,066 | 3/1966 | Gardner et al. . | |
| 3,385,624 | 5/1968 | Baclini | 403/4 X |
| 3,389,819 | 6/1968 | Schumacher . | |
| 3,512,665 | 5/1970 | Westendorf . | |
| 3,794,195 | 2/1974 | Clevenger et al. . | |
| 3,874,533 | 4/1975 | Montgomery et al. . | |
| 3,934,738 | 1/1976 | Arnold . | |
| 3,985,249 | 10/1976 | Aker et al. . | |
| 4,067,467 | 1/1978 | Datta et al. . | |
| 4,071,154 | 1/1978 | Retzlaff . | |
| 4,127,203 | 11/1978 | Arnold . | |
| 4,187,050 | 2/1980 | Barbee | 414/723 |
| 4,203,238 | 5/1980 | Bangert et al. | 37/118 R |
| 4,214,840 | 7/1980 | Beales | 403/31 |
| 4,225,283 | 9/1980 | Baker et al. | 414/723 |
| 4,295,287 | 10/1981 | Natzke et al. | 37/103 |
| 4,297,074 | 10/1981 | Ballinger | 414/723 |
| 4,311,428 | 1/1982 | Arnold | 414/723 |
| 4,397,604 | 8/1983 | McCain | 414/723 |
| 4,436,477 | 3/1984 | Lenertz et al. | 414/723 |
| 4,452,560 | 6/1984 | Coyle et al. | 414/723 |

FOREIGN PATENT DOCUMENTS

| | | | |
|---|---|---|---|
| 8504440 | 10/1985 | PCT Int'l Appl. | 414/723 |

*Primary Examiner*—Leslie J. Paperner

*Attorney, Agent, or Firm*—Hubbard, Thurman, Turner & Tucker

[57] ABSTRACT

A hitch apparatus for detachably connecting a bucket to a power operated boom of a self propelled backhoe or excavator vehicle in which the hitch includes a body having a pair of upstanding side walls for hinge mounting onto the manipulative end of the boom. At the underside of the body secured in a relatively forward location of a bottom wall connecting the sidewalls is a hook member defining a transverse jaw channel in which to receive a transverse hingepin extending between spaced apart support lugs secured to the backside of the bucket. Rearwardly extending downward from the backside of the bottom wall is an elongated transverse sleeve adapted to be received intervening between the lugs of the bucket and containing a cyindrical rotatably displaceable bushing within the bore of the sleeve. The bushing is formed having an eccentric internal bore that by arcuate displacement of the bushing can be axially aligned with opposite apertures in the lugs. A support pin extending through the lugs and bushing secures the hitch apparatus attached to the bucket and can be withdrawn for subsequent detachment.

3 Claims, 3 Drawing Sheets

BACKHOE HITCH APPARATUS

This application is a continuation of application Ser. No. 895,808, filed Aug. 12, 1986, now abandoned.

TECHNICAL FIELD

The technical field to which the invention pertains comprises the field of material handling, and more specifically, to hitch apparatus for attaching and detaching a bucket to and from the boom of a self propelled backhoe or excavation vehicle.

BACKGROUND OF THE INVENTION

Hitch apparatus for attaching and detaching a bucket or other type of material handler from the boom of a backhoe or excavation vehicle are well known and widely used. Exemplifying hitch apparatus of various prior types are the disclosures in U.S. Pat. Nos. 2,447,150; 3,237,795; 3,389,819; 3,794,195; 3,874,533; 3,934,738; 4,127,203; 4,187,050; 4,295,287; 4,311,428; and 4,436,477.

Contributing to the design considerations of such prior hitch units are compatibility between the material handling tool and vehicle, the relative permanency once assembled and/or the attendant problems associated with attachment and detachment when change of the material handling tool is required. The changing of material handling tools mounted on a backhoe dipperstick traditionally has been laborious and time consuming. In recent years considerable effort has been expended toward simplifying this task by connecting different tools to, rather than replacing, the bucket; and by providing connecting mechanisms on the tool and dipperstick which reduce the time and effort required for tool changeover. Such schemes have suffered from various drawbacks, principal of which are the need for precise vertical alignment of the tool and dipperstick, the inability of the backhoe operator either to change tools himself or to make the change without leaving his seat, the necessity of manually locking each tool to the dipperstick or bucket, the danger presented by improperly or incompletely connected tools, and the requirement that a different set of tools be provided for each size or type of backhoe.

The various structures and mechanisms known for that purpose differ somewhat from each other both in their construction and ease of operation in their ability to effect a changeover of a bucket or other material handling attachment as exemplified by the disclosures of the prior patents noted above. In a basic procedure, however, interchange is accomplished by removing two pins that normally secure a bucket to the dipperstick and the linkage, exchanging the bucket and then replacing the pins. Often, and particularly acute after a considerable number of changeovers, the pins must be hammered in and out resulting in damage to the pins themselves as well as the bucket bushings, the linkage arms and/or the dipperstick. In addition, shims are commonly utilized to take up any lateral spacing between the bosses on the bucket and the dipperstick such that alignment of the shims when replacing the pins increases the attendant difficulty of the interchange procedure.

Despite recognition of the foregoing a more ready solution has not heretofore been known.

SUMMARY OF THE INVENTION

This invention relates to a hitch apparatus for interchanging a bucket or other material handling attachment onto the dipperstick of a backhoe or excavation type vehicle. More specifically, the invention relates to a novel hitch apparatus affording the height of simplicity and ease in facilitating such interchange in contrast with the attendant problems and difficulties associated with such similar purpose devices of the prior art. By means of the construction hereof there is enabled the interchange to be accomplished without requiring either a special bucket or modification to a standard bucket, without the removal difficulties of pin replacement from the dipperstick linkage, and/or bucket while enabling a ready exchange to be effected between vehicles and buckets of different manufacture.

In accordance with a preferred aspect of the invention, the foregoing is achieved utilizing a hitch apparatus having a hook member able to receive a transverse pin extending across and between parallel lugs providing a mounting support for the bucket. Once the pin has been received in the jaws of the hook member, the bucket can be lifted by means of the backhoe boom while simultaneously curling the hitch inwardly toward and between the support lugs. Raising the boom allows the pin to fall into the back of the hook. This affords the advantage of ensuring that the pin is fully supported by the back of the hook and therefore, all digging forces will be transmitted through the front and larger pin. At the same time the weight of the hanging bucket on being lifted approximately aligns opposite hinge pin apertures of lower bucket bosses with companion bossed apertures of the hitch containing a rotatable eccentric bushing. When in this arrangement, the operator can manually slide a support pin through the bushing and bosses and after securing the support pin in place the attachment is completed. By means of the eccentric bushing, manufacturing tolerances and wear can be readily allowed for without adversely affecting hitch operation and for effecting alignment, the bushing includes a notched end face that can be interfitted by the shaped end of the support pin when inserted. Forcing the pin in a rotating direction about the axis of the bushing arcuately displaces the eccentric bushing through a limited angle until complete bore alignment is achieved for receipt of the support pin which can then be adequately secured by means of cotter pins or the like.

Additional advantages afforded by the above construction over and above the simplicity and ease of installation include a self cleaning structure in which dirt or other material is not collected. Good visibility for the operator is provided while adding of width to the bucket is clearly avoided. At the same time, the hitch hereof allows buckets of one manufacturer to be utilized with a backhoe or excavator vehicle of another manufacturer which as can be appreciated is a significant benefit to an owner having a plurality of diversely manufactured tractors and/or a variety of buckets of different manufacture.

It is therefore an object of the invention to provide a novel hitch apparatus for facilitating the interchange of buckets or other material handling attachments to the power operated boom of a backhoe or excavator apparatus.

It is a further object of the invention to effect the previous object with a structure that significantly facilitates the simplicity and ease of such interchange.

It is a still further object of the invention to effect the foregoing objects with a relatively simple mechanism that minimizes if not overcomes the difficulties and problems associated with such interchanges of the prior art.

The above noted features and advantages of the invention as well as other superior aspects thereof will be further appreciated by those skilled in the art upon reading the detailed description which follows in conjunction with the drawings.

DESCRIPTION OF THE PREFERRED EMBODIMENT

Figure 1:
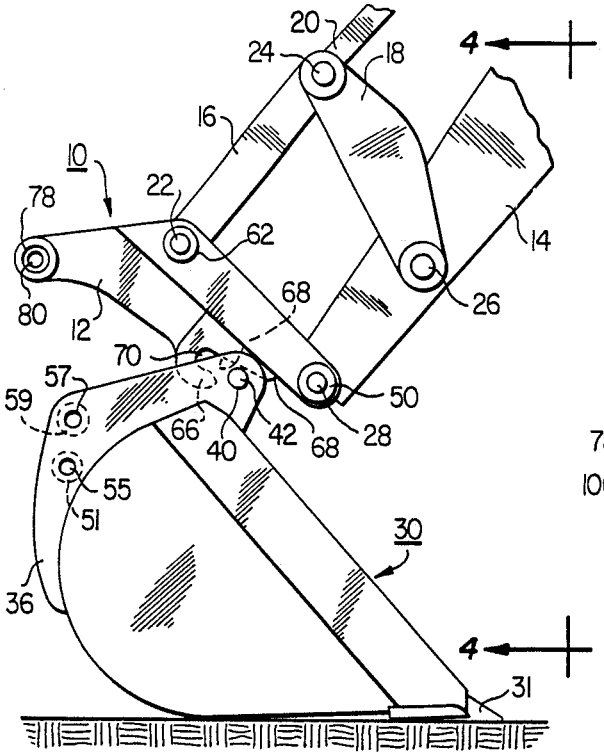
FIGS. 1-3 are partially broken away side elevations of a backhoe dipperstick and the hitch mechanism hereof, the figures being slightly simplified and illustrating three stages in the attachment of a bucket to the dipperstick.
Figure 2:
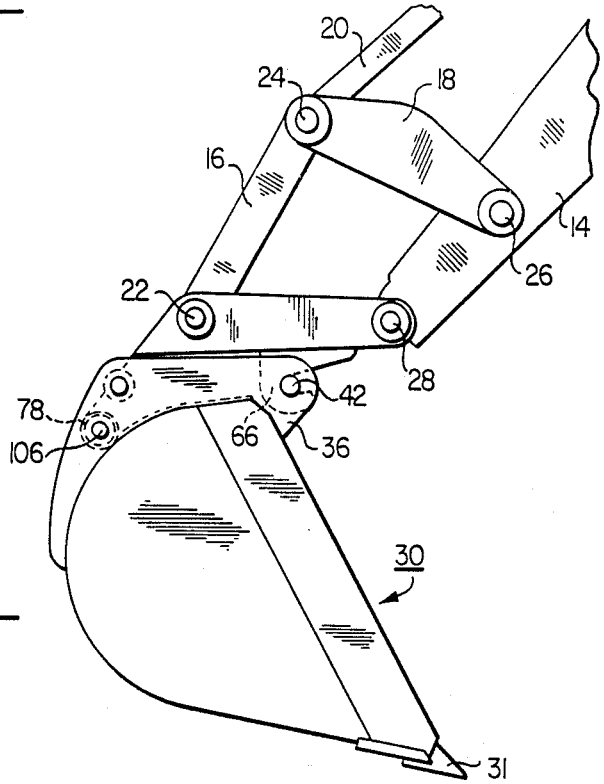
Figure 3:
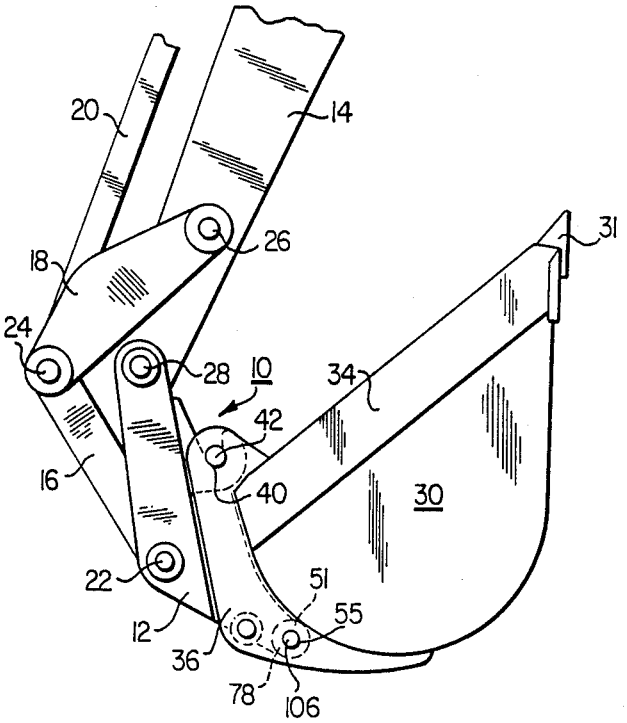
Figure 4:
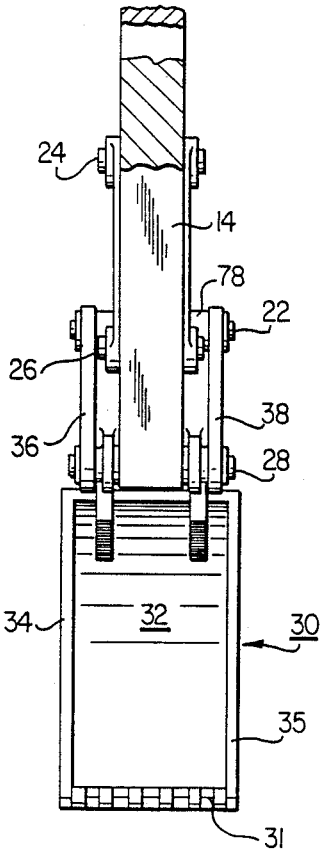
FIG. 4 is a front elevation as seen substantially from the position 4—4 of FIG. 1.

In the description which follows, like parts are marked throughout the specification and drawings with the same reference numerals respectively. Drawing figures are not necessarily to scale and in certain views, parts may be drawn rotated into the plane of the drawing for purposes of clarity.

Referring now to FIGS. 1-6, the hitch apparatus of the invention is generally designated 10 and includes a main body 12 adapted first to be connected to a dipperstick 14 of a backhoe or excavator (not shown) type vehicle. For controlling operational movement thereat, there is provided links 16 and 18 actuated through the piston 20 of a cylinder (not shown). Securing the components in this relationship are transverse hingepins 22, 24 and 26 which in response to extension and retraction of piston 20 enable body 12 of hitch apparatus 10 to be displaced pivotally about the axis of hingepin 28.

Adapted to be attached or detached from hitch apparatus 10 is a conventional material handling bucket 30 having claw teeth 31. As here shown, bucket 30 includes an opening or scoop 32 between side walls 34 and 35, and a pair of upstanding spaced apart contour fitting support lugs 36 and 38 welded to the backside of the bucket. Permanently contained for the purposes hereof transversely extending through aligned and opposite apertures 40 in lugs 36 and 38 is an upper bucket pin 42 for reasons as will be described. Displaced rearward and downward thereof are opposite bosses 51 and 53 containing bores 55. Available as an alternative to bores 55 are aligned bores 57 having opposite bosses 59 and 61. As is well known, selection of bores 55 affords a relatively greater digging force by virtue of its longer moment from the pivot while selection of bores 57 allows greater rotation or curl that is advantageous in truck loading.

Figure 5:
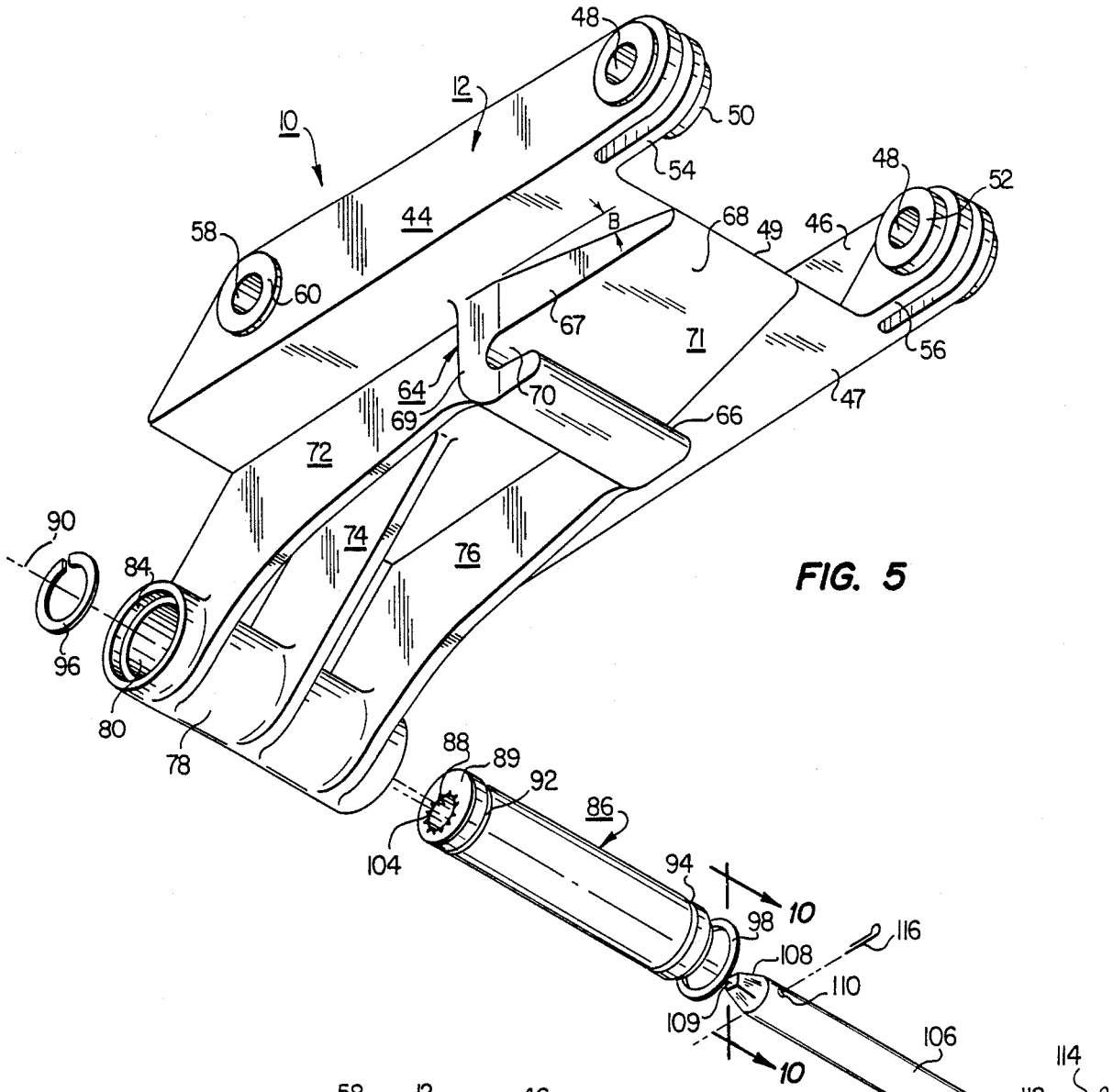
FIG. 5 is an underside isometric and partially exploded view of the hitch mechanism hereof.
Figure 6:
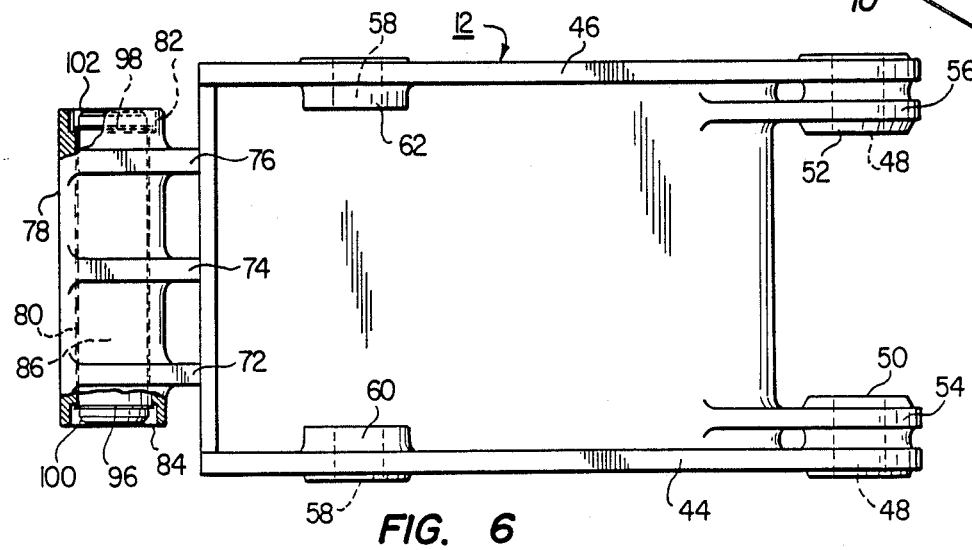
FIG. 6 is a plan view of the hitch mechanism of FIG. 5.

Referring additionally to FIGS. 5 and 6, it will be seen that body 12 of hitch apparatus 10 is comprised of a machined casting that includes an upper section comprised of spaced apart parallel side plates 44 and 46. Joining the side plates at their underside is a flush bottom wall 47 that terminates forwardly in an edge face 49. Aligned between the side plates are a pair of opposite bosses 50 and 52 containing bores 48 and receiving added structural support from longitudinal rib flanges 54 and 56 respectively in order to receive and contain pivot hingepin 28. Rearward thereof are aligned bores 58 extending through opposite bosses 60 and 62 formed in side plates 44 and 46 respectively in order to receive and contain transverse hingepin 22.

Integrally secured downwardly depending from the underside of bottom wall 47 is a centrally located hook member 64 formed having a nose portion 66 spaced from the underside of an inclined sloping surface 68 of body 71 defining a transverse slightly cradled jaw channel 70 in which to receive and contain pin 42 as will be described. For purposes hereof, support body 71 converges along both side faces 67 at an angle B in the horizontal of about 15 degrees from its merger with the back support 69 to the lip or edge face 49. Extending from the backside of hook 64 and likewise integral with the underside of wall 47 are three spaced apart longitudinally extending and downwardly depending flange ribs 72, 74 and 76. At their distal ends the flange ribs support tubular sleeve 78 rearward and below the main body 12. Extending through sleeve 78 is a transverse bore 80 enlarged at opposite ends via counterbores 82 and 84.

Figure 7:
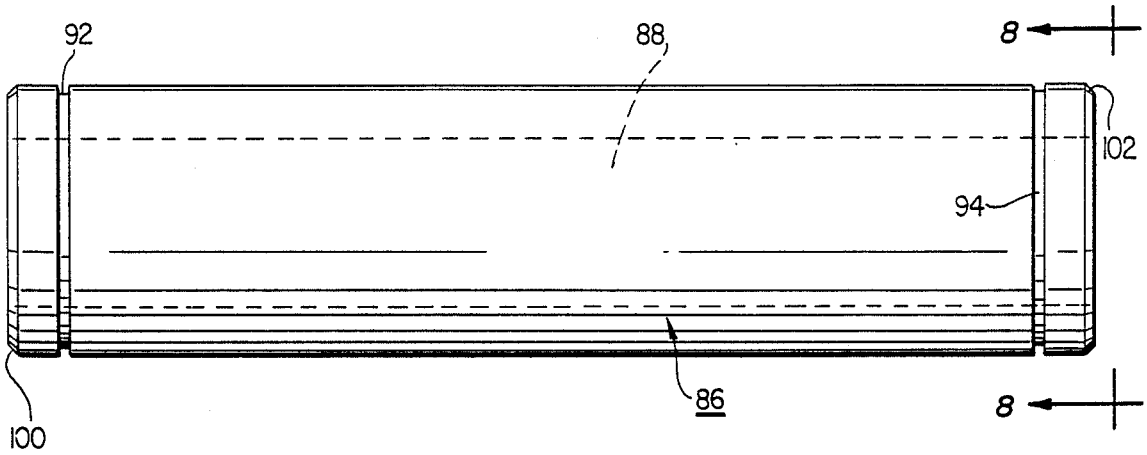
FIG. 7 is a plan view of the eccentric bushing for the hitch mechanism hereof.
Figure 10:
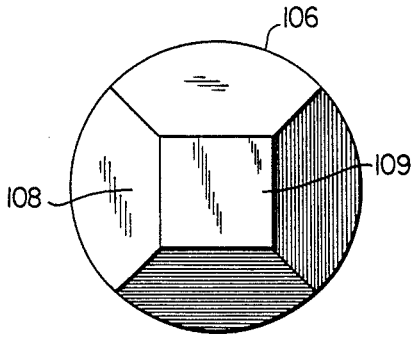
FIG. 10 is a view of the support pin as seen substantially from the position 10—10 of FIG. 5.
Figure 8:
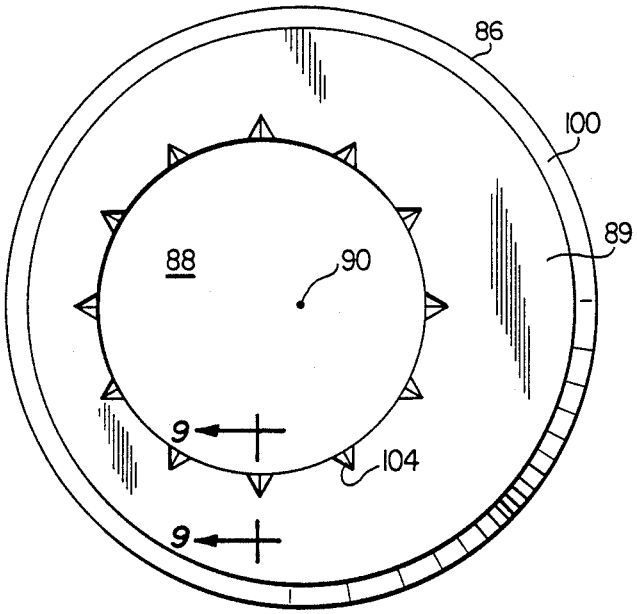
FIG. 8 is an enlarged end elevation as seen substantially from the position 8—8 of FIG. 7.

Adapted to be contained in bore 80 (see also FIGS. 7-9) is an elongated cylindrical bushing 86 diametrically sized so as to be free to be arcuately displaced within bore 80. Longitudinally extending through the bushing is an internal bore 88 eccentrically offset with respect to the center axis of the bushing cylinder. Formed about the periphery adjacent each end of the bushing are recessed grooves 92 and 94 in which to receive retaining rings 96 and 98 respectively for securing the bushing in place within sleeve 78 (see FIG. 6). Each opposite end 100 and 102 of the bushing is chamfered for convenience of insertion within bore 80.

Figure 9:
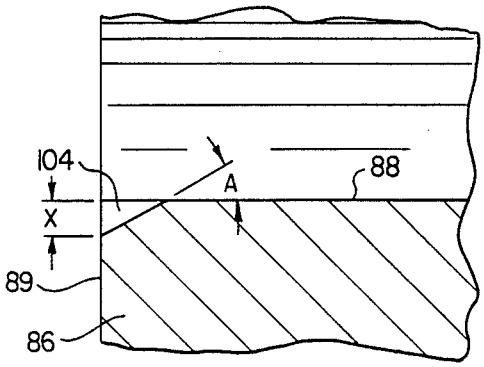
FIG. 9 is an enlarged fragmentary section as taken substantially from the position 9—9 of FIG. 8.

Contained on one or both end faces 89 of bushing 86 are a plurality of arcuately spaced broached notches 104 surrounding bore 88 and which for the embodiment being described, are angularly displaced about 30° from each other. The notches are also angled radially as to typically deviate from the horizontal at an angle A of about 28° to effect a frontal depth "X" of about 5/32 inches (FIG. 9). Adapted to operably cooperate with the notches 104 is an elongated hardened pin 106 the forward end of which includes a four sided tapered formation 108 leading to a blunt nose 109. The diameter and overall length of pin 106 is sufficient to penetrate bore 88 of bushing 86 beyond both end faces of sleeve 78 so as to expose apertures 110 and 112 for receipt of cotter pins 114 and 116.

In operation, bucket 30 represents a substantially conventional construction of a scoop design on which spaced apart upstanding support lugs 36 and 38 are welded spaced apart along the backside. Secured extending transversely through and between opposite bores 40 of the lugs is an upper pin 42 that remains continuously in place. Bucket 30 is assumed to be positioned on the ground in the relationship of FIG. 1, and hitch 10 previously connected to dipperstick 14 and guide link 16 via hinge pins 22 and 28 and bushing 86 is in place in sleeve 78. The operator of the backhoe/excavator apparatus then proceeds to lower hitch 10 until sloping surface 68 of body 12 engages the topside of bucket pin 42. By then drawing the hitch horizontally toward the vehicle, alignment of the bucket is aided by tapered sides 67 and enabling hook 64 to be moved into an embracing interlock relation with pin 42 as the pin is received in a slightly cradled jaw channel 70. The weight and force of the hitch on pin 42 in the latter relation prevents the bucket from sliding or shifting. After the upper pin 42 has been hooked as aforesaid, the operator simultaneously lifts the bucket by manipulation of the vehicle controls causing the hitch to curl inward into the orientation of FIG. 2. The weight of the hanging bucket in that orientation will approximately align sleeve 78 on hitch 10 with the bosses 51 and 53 on lugs 36 and 38 containing bore 55 for receipt of the lower bucket pin 106 through bushing 86. To perfect alignment of bore 88 as will enable insertion of pin 106, eccentric bushing 86 can be arcuately displaced within sleeve bore 80. To displace bushing 86 with the components arranged in the relationship of FIG. 2, the machined end 108 of pin 106 is caused to engage a broached notch 104 in the bushing end face 89 by being placed through the bucket boss 53. With its shaped edge 108 engaging the bushing notch 104, a rotationally directed force is applied around the pin causing the bushing to be arcuately displaced until alignment is achieved between eccentric bushing bore 88 and lug bores 55. Once aligned, pin 106 is extended inward and then secured at opposite ends via cotter pins 114 and 116. At that point the hitch connection is completed and the bucket can be operated by the vehicle controls in a conventional manner.

Since further rotation of bushing 86 in that relation is thereafter prevented, front pin 42 remains firmly seated at the back of hook jaw channel 70. This ensures proper transmission of the digging forces. With a taper of angle B on the side surface 67 of the hitch, a tight side to side fit in the bucket is provided while the lower bosses 51 and 53 when aligned with sleeve 78 provide a loose side to side fit thereat so as to reduce the possibility of any binding in the course of assembly.

By the above description, there is disclosed a novel hitch apparatus that is readily attached and detached from buckets of conventional construction. A special bucket design is not required nor is modification to a standard bucket normally required. Once the hitch is mounted on the dipperstick and linkage, it remains in place for the assembly associated with attachment and detachment of the bucket. Use of an eccentric bushing readily allows for both manufacturing tolerances and subsequent wear without adversely affecting operational performance of the hitch. By virtue of the surface contours associated with the hitch, it is substantially self-cleaning so as not to collect and hold dirt or other materials, and yet is readily visible for the operator during the assembly and disassembly steps. The hitch does not increase the bucket width and yet and most important, it allows the bucket of one manufacturer to be utilized on the tractor of another manufacturer. To effect the foregoing, the upper portion of the hitch can, for example, be sized to fit a backhoe of one manufacturer while the hook and eccentric bushing are positioned to accommodate the lug bosses of another manufacturer. It will be appreciated that this affords a significant advantage to a contractor having a tractor and a variety of buckets of different manufacture as to afford a hitching versatility not previously known.

Since many changes could be made in the above construction and many apparently widely different embodiments of this invention could be made without departing from the scope thereof, it is intended that all matter contained in the drawings and specification shall be interpreted as illustrative and not in a limiting sense.

We claim:

1. In combination, a vehicle having a manipulating boom, an implement to be manipulated thereby, and a hitch means for detachably coupling the implement to the boom comprising:

first coupling means connected to one of the boom or the implement, and second coupling means connected to the other of the boom or the implement, one of the coupling means including bar means and a pair of eyelet means aligned along an axis spaced from and generally parallel to the bar means, the other of the coupling means including a hook means for engaging the bar means and a bushing rotatably journaled in a cylindrical bore and including a smaller bore located eccentrically to the cylindrical bore such that upon rotation of the bushing the smaller bore is moved relative to the hook means, the bushing being positionable generally between the eyelet means of said one coupling means when the hook means operatively engages the bar means and alignable with the eyelet means by rotation of the bushing means, and pin means insertable through the eyelet means and the bushing means when aligned to couple the implement to the boom, the pin means and bushing means including cooperatively interacting means for rotating the bushing means into alignment with the eyelet means as the implement is being coupled to the boom.

2. A hitch apparatus for mounting a material handler unit to a power operated boom of a self propelled vehicle which material handler unit to be mounted includes a hingepin supported transversely in aligned apertures of opposite upstanding support lugs secured spaced apart on the backside of the handler unit; said hitch apparatus comprising:

(a) a body defining parallel upstanding sidewalls having bores transversely aligned in said sidewalls adapted for mounting onto the manipulative end of the power boom; and a bottom wall transversely joining said side walls along an underportion thereof;

(b) a hook member supported at a relatively forward location on the underside of said bottom wall and adapted to be inserted intervening between the support lugs of the handler unit to be mounted, said hook member defining a jaw engagement surface in which to receive the transverse hingepin of the unit in an interlocking engagement therewith;

(c) tubular sleeve means supported from a relatively rearward underside of said bottom wall adapted to be inserted intervening between the support lugs of the handler unit in general alignment with an opposite pair of apertures defined in the unit support lugs spaced from said supported hingepin; and (d) securement means to secure said sleeve means to the handler unit between the support lugs of the handler unit, said securement means including an elongated pin insertable through the opposite pair of apertures of said lugs and said intervening sleeve means for securing said hitch apparatus to said material handler unit;

(e) adjustment means operative to preset the axial alignment between said securement means and said pair of lug apertures for receipt of said elongated pin, wherein said sleeve means contain a central bore and said adjustable means includes an elongated cylindrical bushing positioned in the bore of said sleeve means and having an internal bore contained on an axis eccentrically offset with respect to the axis of its cylinder, and said elongated pin is adapted when inserted to extend through the internal bore of said bushing, said bushing being supported in the bore of said sleeve means so as to be rotated therein for operationally presetting said axial alignment;

(f) a plurality of angularly displaced notches about at least one end face of said bushing in communication with its internal bore, said elongated pin including an end formation adapted to interfit in said notches so as to enable a rotational force to be applied against said pin when interfit with a notch to rotate said bushing within said sleeve means for operationally presetting said axial alignment.

3. A hitch apparatus according to claim 2 wherein:

said notches are angled in a radial direction to effect a predetermined frontal depth for convenient insertion of the end formation of said pin.

* * * * *